US007431080B2

(12) United States Patent
Wright et al.

(10) Patent No.: US 7,431,080 B2
(45) Date of Patent: Oct. 7, 2008

(54) ANCHOR DEVICE TO RELIEVE TENSION FROM THE ROPE SOCKET PRIOR TO PERFORATING A WELL

(75) Inventors: Alphie Wright, Kingwood, TX (US); Garry Kaiser, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/610,270

(22) Filed: Jun. 30, 2003

(65) Prior Publication Data

US 2004/0112591 A1 Jun. 17, 2004

Related U.S. Application Data

(60) Provisional application No. 60/433,671, filed on Dec. 16, 2002.

(51) Int. Cl.
*E21B 43/119* (2006.01)
*E21B 40/00* (2006.01)
*E21B 23/01* (2006.01)

(52) U.S. Cl. ..... 166/210; 166/216; 166/243

(58) Field of Classification Search ..... 166/381, 166/382, 297, 210, 216, 134, 243
See application file for complete search history.

(56) References Cited

U.S. PATENT DOCUMENTS

| | | | | | |
|---|---|---|---|---|---|
| 2,173,903 | A | | 9/1939 | Halliburton | |
| 3,026,941 | A | * | 3/1962 | Muse | 166/216 |
| 3,096,823 | A | | 7/1963 | Crowe | |
| 3,391,742 | A | * | 7/1968 | Davis | 166/139 |
| 4,060,131 | A | | 11/1977 | Kenneday | |
| 4,284,137 | A | | 8/1981 | Taylor | |
| 4,317,485 | A | | 3/1982 | Ross | |
| 4,554,975 | A | | 11/1985 | Vann et al. | |
| 4,580,631 | A | | 4/1986 | Baugh | |
| 4,616,703 | A | | 10/1986 | Laurent et al. | |
| 4,750,564 | A | * | 6/1988 | Pettigrew et al. | 166/387 |
| 4,917,189 | A | * | 4/1990 | George et al. | 166/297 |
| 4,949,793 | A | | 8/1990 | Rubbo | |
| 5,058,680 | A | * | 10/1991 | Huber et al. | 166/297 |
| 5,067,568 | A | | 11/1991 | Yates, Jr. et al. | |
| 5,220,962 | A | * | 6/1993 | Muller et al. | 166/369 |
| 5,429,192 | A | * | 7/1995 | Huber et al. | 166/297 |
| 5,771,969 | A | | 6/1998 | Garay | |
| 5,971,070 | A | | 10/1999 | Ross et al. | |
| 6,056,061 | A | | 5/2000 | Ross et al. | |
| 6,059,033 | A | | 5/2000 | Ross et al. | |
| 6,131,663 | A | * | 10/2000 | Henley et al. | 166/373 |
| 6,155,346 | A | | 12/2000 | Aldridge | |
| 6,179,055 | B1 | | 1/2001 | Sallwasser et al. | |
| 6,315,043 | B1 | | 11/2001 | Farrant et al. | |
| 6,550,540 | B2 | * | 4/2003 | Trent | 166/382 |
| 2002/0166670 | A1 | | 11/2002 | Trent | |

* cited by examiner

*Primary Examiner*—Shane Bomar
(74) *Attorney, Agent, or Firm*—Bracewell & Giuliani LLP

(57) ABSTRACT

An anchoring sub used in combination with hydrocarbon exploration and production tools, such as perforating guns and logging devices, within a wellbore. The anchor sub is reversible and includes a mandrel, a slip assembly and a slip cone, where the slip assembly selectively travels up and down the mandrel and is able to mate with the slip cone. The anchor sub secures itself to the inner circumference of a wellbore when the slip assembly is mated with the slip cone. Mating and de-mating of the slip assembly with the slip cone is accomplished by selective up and down movement of the anchor sub.

22 Claims, 3 Drawing Sheets

ANCHOR DEVICE TO RELIEVE TENSION FROM THE ROPE SOCKET PRIOR TO PERFORATING A WELL

RELATED APPLICATIONS

This application claims priority from co-pending U.S. Provisional Application No. 60/433,671, filed Dec. 16, 2002, the full disclosure of which is hereby incorporated by reference herein.

BACKGROUND OF THE INVENTION

1. Field of the Invention

The invention relates generally to the field of exploration and production of hydrocarbons from wellbores. More specifically, the present invention relates to a method and apparatus to position and secure production and exploration tools within a wellbore.

2. Description of Related Art

Perforating guns are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Included with the perforating guns are shaped charges that typically include a housing, a liner, and a quantity of high explosive inserted between the liner and the housing. When the high explosive is detonated, the force of the detonation collapses the liner and ejects it from one end of the charge at very high velocity in a pattern called a "jet". The jet penetrates the casing, the cement and a quantity of the formation.

Generally the wellbore pressure is different from the pressure within the geological formation that is to be perforated, thus upon perforation pressure equalization occurs between the formation and the wellbore which in turn produces either flow into the wellbore from the formation, or into the formation from the wellbore. When the wellbore pressure is greater than the formation pressure this is known as an overbalanced situation, whereas when the formation pressure exceeds the wellbore pressure is known as an underbalanced situation.

Many times when the perforating guns are detonated, the forces applied to the perforating guns are not balanced and can produce a resultant force that thrusts the perforating gun suddenly upward or downward upon detonation. This can be exacerbated in an overbalanced or underbalanced condition. Attempts have been made in the past to prevent perforating guns from being jolted within the wellbore; such as by securing or anchoring the guns within the wellbore just prior to firing the perforating guns. These attempts include adding anchoring devices to perforating guns where the anchoring devices are actuated mechanically, electrical, or hydraulically. However all of the previously developed devices suffer from one or more of the following disadvantages. For example, electrical or hydraulically activated anchors are susceptible to problems with reliability, and none of the above noted devices is capable of resetting its anchor should the perforating gun receive an impulse from an unexpected direction. Examples of these devices can be found in the following patents: U.S. Pat. Nos. 6,314,043, 5,971,070, 4,554,975, and 4,284,137.

Some anchors are designed to prevent movement in a single direction, these would be used in a highly overbalanced or highly underbalanced case. In overbalanced wellbores it is expected that subsequent to perforating the wellbore, the higher pressure wellbore fluids would quickly migrate into the surrounding formation, that in turn would pull the perforating gun downward and stress the wireline attached to the perforating gun. Thus in overbalanced cases, when using an anchor that prevents movement in only one direction, the anchor would be positioned to prevent downward movement of the perforating gun. However if the forces from the individual jets fired from the perforating gun produce a resultant upward force onto the perforating gun, the anchor can become unseated. If the anchor becomes unseated, the perforating gun will be thrust upward for some distance and then begin to fall, unsupported, within the wellbore. During the ascent of the perforating gun, slack will accumulate in the wireline above the perforating gun. After the perforating gun begins to fall, it will begin to drop within the wellbore until no slack remains in the wireline. Depending on how much speed the perforating gun has attained, it can break the wireline when the slack in the wireline runs out and the perforating gun pulls the wireline taut.

Therefore, there exists a need for a device that reliably anchors a perforating gun within a wellbore during perforations, and is capable of resetting the anchor without the threat of damaging the wireline.

BRIEF SUMMARY OF THE INVENTION

One embodiment of the present invention involves an anchoring sub for use within a wellbore comprising; a mandrel disposed in a first position having a pattern disposed on the outer surface of said mandrel; and a slip assembly slideably disposed on said mandrel. Selective disposition of the slip assembly with the pattern anchors the anchoring sub to the wellbore against downward movement, and wherein said anchoring sub re-anchors within the wellbore after upward and then successive downward movement of said anchoring sub. Further, the slip assembly can anchor the anchoring sub to the wellbore. The slip assembly automatically becomes selectively repositioned on the pattern with vertical movement of the anchoring sub. Downward movement of one embodiment of the anchoring sub during re-anchoring is less distance than the upward movement, the downward movement can be less than 1 foot, or less than 8 inches.

The present invention can comprise a slip cone disposed on the mandrel engageable by the slip assembly. The slip assembly is urged outward when it engages the slip cone. This in turn produces anchoring contact of the anchoring sub with the wellbore. Also alternatively included with the slip assembly is at least one rocker slip engageable with the wellbore to provide anchoring contact with the wellbore. Further, the present invention can comprise at least one drag slip disposed on the slip assembly. The drag slip is contactable with the wellbore thereby providing a drag force onto the slip assembly when the anchoring sub moves within the wellbore. The drag force has a direction opposite to the direction of movement of the anchoring sub.

In one alternative embodiment of the present invention, the mandrel can be in a second position that is reversed from the first position. In this alternative reversed position, selective disposition of the slip assembly with the pattern anchors the anchoring sub to the wellbore against upward movement.

The slip assembly of the present invention can be engageable with the pattern in more than one position that comprises an anchoring position, a shock position, a lowering position, and a raising position. When the slip assembly is engaged with the pattern in the anchoring position, the anchoring sub is anchored within the wellbore. Here the slip assembly anchors the anchoring sub within the wellbore.

When the slip assembly is engaged with the pattern in the shock position, the anchoring sub does not limit upward travel. When the slip assembly is engaged with the pattern in the shock position, the anchoring sub limits downward travel. The downward travel can be limited to less than 1 foot, or even less than 8 inches. When the slip assembly is engaged with the pattern in the lowering or the raising position, the anchoring sub does not limit upward or downward travel.

An alternative embodiment of the present invention includes an anchoring sub for use with hydrocarbon exploration and production tools within a wellbore comprising: an elongated mandrel having a first end and a second end and an outer surface connecting the first end to the second end. This embodiment of the anchoring sub includes a slip assembly disposed along the outer surface of the mandrel between the first end and the second end. The slip assembly comprising at least one pin, at least one drag block, and at least one rocker slip. A slip cone can be included that is secured to the outer surface of the mandrel between the first end and the second end. The slip cone is engageable by the slip assembly to urge the slip assembly outward and securedly contact the inner surface of the wellbore. A slotted sleeve can be disposed along the outer surface of the mandrel between the slip cone and the second end of the mandrel. The slotted sleeve includes a series of vertical slots circumscribing the slotted sleeve.

The pin is secured to the slip assembly and is travelable within the vertical slots and can be selectively positioned within the vertical slots. Selective positioning of the pin within the vertical slots can provide vertical travel of the slip assembly up and down the outer surface of the mandrel. Positioning the pin within a first slot provides engaging contact of the slip assembly with the slip cone and positioning the pin within a second slot provides for placing the slip assembly in a pick up position. Moreover, positioning the pin within the first position provides for the anchoring sub to be upwardly motivated within the wellbore while still providing for reengagement of the slip assembly with the slip cone when the anchoring sub is subsequently downwardly motivated.

This embodiment of the anchoring sub of claim 1 further comprises a wireline connection at its first end and second end thereby providing wireline communication through the anchoring sub. The vertical orientation of the anchoring sub is reversible such that when the slip cone is positioned above the slip assembly and when the slip assembly contacts the slip cone thereby causing the slip assembly to engage the wellbore inner radius. The anchoring sub is prevented from downward movement within the wellbore, and when the slip cone is positioned below the slip assembly and when the slip assembly contacts the slip cone thereby causing the slip cone to engage the wellbore inner radius, the anchoring sub is prevented from upward movement within the wellbore.

Any embodiment of the anchoring sub can include any type of downhole tool attached to it, such as a perforating device, a seismic device, logging tools, or any other device lowered into a wellbore.

DETAILED DESCRIPTION OF THE INVENTION

Figure 1A:
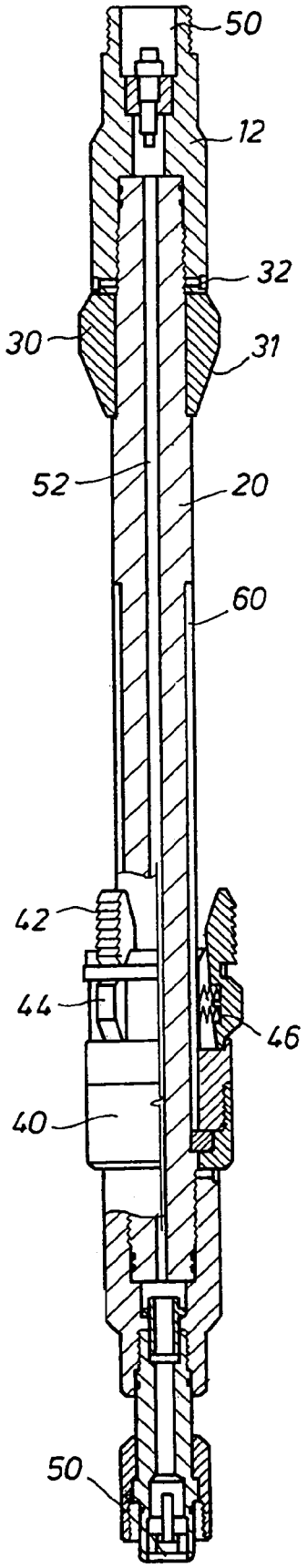
FIG. 1*a* depicts a cross sectional view of one aspect of an anchor sub of the present invention.

For the purposes of clarity, directional references with respect to the present invention have been indicated in relation to the surface of the earth. Therefore in describing the present invention, the term "upper" means closer to the surface, whereas the terms "lower" and "below" mean further from the surface. With reference to the drawing herein, an anchoring sub 10 is shown in FIG. 1. This embodiment of the invention comprises a mandrel 20, a slip cone 30, and a slip assembly 40. It is preferred that the mandrel 20 be cylindrical and elongated such that it is suitable for insertion into a hydrocarbon producing wellbore. However other shapes and forms for the mandrel 20 are considered as possible alternative embodiments as long as they perform the required function. Affixed to one end of the mandrel 20 is a slip cone 30 that is beveled on its lower end 31 and terminates on its upper end 32 with a connection to the sub upper connection 12.

To accommodate the addition of perforating guns or other downhole equipment that might be connected to the anchor sub 10, a wireline 52 and wireline connection 50 are included with the present invention. The wireline 52 is capable of transmitting all signals, data, or anything else typically conveyed along a wireline. The wireline connection 50 is included at both ends of the anchor sub 10.

Slidingly connected to the outer surface of the mandrel 20 is a slip assembly 40. The slip assembly 40 includes at least one rocker slip 42, at least one drag block 44, and springs 46. As is well known, when the anchoring sub 10 is inserted into a wellbore the drag blocks 44 are designed to contact the inner surface of the wellbore, which is often lined with downhole casing. The magnitude of the contact force is designed to be sufficient to provide a resultant upward force onto the slip assembly 40 and slide the slip assembly 40 upward along the mandrel 20. However, the contact force is not of sufficient magnitude to prevent the anchor sub 10 (and other possible devices attached to the anchor sub 10) from being easily lowered within the wellbore.

When the slip assembly 40 is allowed to slide up the mandrel 20 until the rocker slips 42 are in engaging contact with the slip cone 30; the rocker slips 42 are urged outward by the beveled shape of the slip cone 30 into securing engagement with the inner surface of the wellbore (or casing). As long as the slip assembly 40 maintains engaging contact with the slip cone 30, the anchor sub 10 is correspondingly secured within the wellbore at the depth where the rocker slips 42 have engaged the wellbore inner surface. When the slip assembly 40 is not in contact with the slip cone, springs 46 generally draw the rocker slips 42 inward toward the mandrel 20 such that the outer radius of the rocker slips 42 is less than the inner circumference of the wellbore that allows for substantially unrestricted passage of the anchor sub 10 within the wellbore.

Figure 1B:
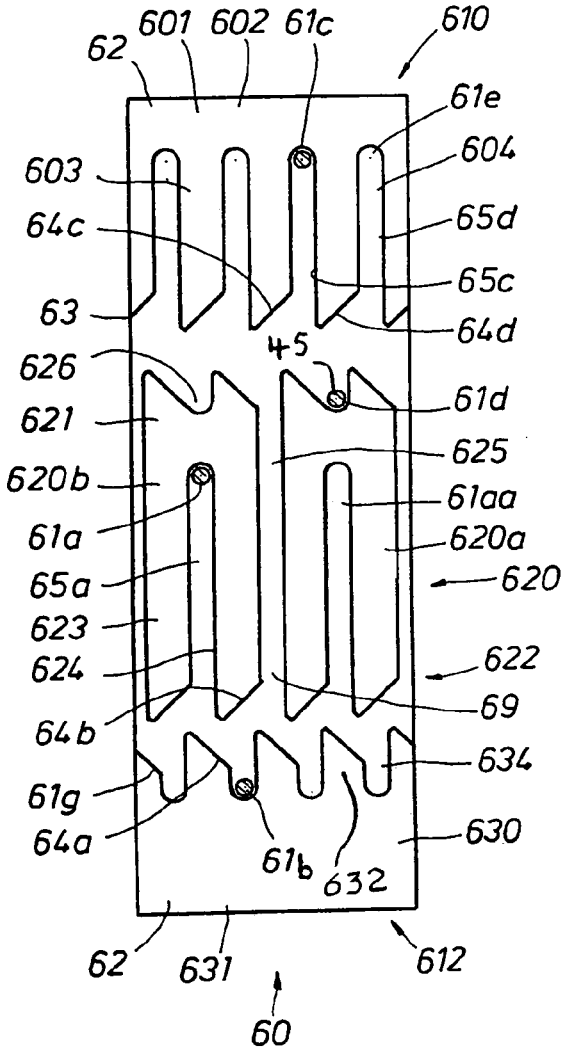
FIG. 1*b* illustrates a perspective view of one embodiment of a slotted sleeve of the present invention.

Depicted in FIG. 1*b* is one embodiment of a slotted sleeve 60 of the present invention. The slotted sleeve 60 is substantially cylindrical having a first end 610 and a second end 612. The slotted sleeve 60 circumscribes the entire circumference of the mandrel 20 along a portion of the length of the mandrel 20. FIG. 1*b* depicts the entire 360° circumference of the slotted sleeve 60 in a two dimensional illustration. Disposed on the outer surface of the slotted sleeve 60 is a pattern that comprises a series of raised portions and slots. It is preferred that the pattern be symmetric about the slotted sleeve 60. The pattern includes a series of raised portions 62, comprising a first raised portion 601, a second raised portion 620, and a third raised portion 630. The first raised portion 601 is comprised of a raised base 602 and raised ledges 603. The raised base 602 circumscribes the slotted sleeve 60 at the first end 610 of the slotted sleeve 60. The raised ledges 603 have substantially parallel sides and initiate on one of their ends at the raised base 602. The opposite ends of the raised ledges 603 each terminate at an angle oblique to the sides of each of the raised ledges 603. Further, it is preferred that the terminating ends of each of the raised ledges 603 all run in a substantially parallel direction. Disposed between each adjacent raised ledge 603 are top portion vertical slots 604 that extend from the raised base 602 to the terminating ends of the raised ledge 603. The top portion vertical slots 604 are closed at the raised base 602 and open at the terminating ends of the raised ledge 603.

The second raised portion 620 includes a first section 621, a second section 622, and sides that run substantially parallel with the sides of the raised ledges 603. The first section 621 is proximate to the first raised portion 610. Preferably, the second raised portion 620 comprises two segments (620*a*, 620*b*), where the edge of each segment that faces the first raised portion 601 provides an "S" shaped profile 626 formed by two adjacent obliques. The obliques formed on the first section 621 are substantially perpendicular to the obliques formed on the raised ledges 603. Each segment 620*a* and 620*b* contains raised fingers 623 that extend toward the third raised portion 630. Like the raised ledges 603, the raised fingers 623 terminate with oblique angles and have sides mostly parallel to each of the other raised fingers 623. An inner slot 624 is formed on each segment (620*a*, 620*b*) of the second raised portion 620 and a transverse slot 625 lies between the first segment 620*a* and the second segment 620*b*. The inner slot 624 is closed proximate to the first section 621 and open on its other end. Both the inner slot 624 and the transverse slot 625 are largely parallel with the axis of the slotted sleeve 60.

The third raised portion 630 includes a base 631 and a series of raised studs 632. The base 631 circumscribes the second end 612 of the slotted sleeve 60 and the raised studs 632 extend from the base 631 toward the second raised section 620. The sides of the raised studs 632 are all mostly parallel with the axis of the slotted sleeve 60. Obliques are formed on the ends of the studs 632 opposite the base 631, where the obliques of the raised studs 632 are largely perpendicular to the obliques formed on the raised ledges 603. Lower slots 634 lie between each adjacent raised stud 632. The lower slots 634 are closed proximate to the base 631 and open at the obliques on the raised studs 632.

Preferably the slotted sleeve 60 is integrally formed with the mandrel 20 such that the bottom of each of the slots coincides with the outer circumference of the mandrel 20, and where the top of the slots terminate coincides with the outermost surface of each of the raised portions (601, 620, 630). Alternatively, the slotted sleeve 60 can comprise an elongated annular member whose inner circumference is attached to the outer circumference of the mandrel 20. In this alternative configuration, the slotted sleeve 60 can be attached to the mandrel 20 by any one of a number of currently known or later developed attachment methods, such as by welding, fasteners, or a threaded connection.

At least one pin 45 is included with the slip assembly 40 that is formed to fit within the slots disposed on the slotted sleeve 60. The pin is secured within the slip assembly 40 on one of its ends and extends on its other end into the slots formed on the outer surface of the slotted sleeve 60. The pin can be selectively positioned within adjacent slots formed on the slotted sleeve 60 when the pin is traversed within a particular slot and guided by one of the obliquely angled projections provided on the raised surface of the slotted sleeve 60. For the purposes of clarity and disclosure, the obliquely angled ends have been identified as 64*a-d*.

For example, in operation when the anchoring sub 10 is lowered into a wellbore the pin is generally in location 61*a*, referred to herein as the lowering position. In order to "set" the anchoring sub 10 within a wellbore, the slip assembly 40 should be at the slip cone 30, for this to occur, the pin should be location 61*c*. In this embodiment of the invention it is preferred that the anchoring sub 10 be oriented such that the slip assembly 40 is lower, or further from the earth's surface, than the slip cone 30. Thus as the anchoring sub 10 is lowered into a wellbore, and the pin is in location 61*a*, the drag blocks 44 will rub the inner circumference of the wellbore to produce an upwardly resultant force on the slip assembly 40. The resultant force on the slip assembly 40 pushes the pin upward against location 61*a* thereby securing the slip assembly 40 at a location on the mandrel 20 that is away from the slip cone 30. While the preferred manner of lowering the anchoring sub 10 into a wellbore is with a wireline or slickline, other techniques exist, such as tubing or coiled tubing.

As noted above, moving the drag blocks 44 within the wellbore results in a drag force exerted onto the slip assembly 40 that is opposite in direction to the travel of the anchor sub 10. Accordingly, the slip assembly 40 will move in a direction opposite the direction of the anchor sub 10 until the pin contacts the base of one of the slots. As discussed below, moving the anchoring sub 10 upward and downward within the wellbore will in turn cause the slip assembly 40 to move downward and upward respectively along the mandrel 20 and eventually allow the pin to move into location 61*c* thereby "setting" the anchor sub in the wellbore.

More specifically, as the slip assembly 40 moves downward, caused by upward movement of the anchoring sub 10, the pin will move downward as well from position 61*a* through the inner slot 624 until it contacts the deflecting ledge 64*a* on the oblique of the raised stud 631. With further upward movement of the anchoring sub 10, the pin is urged downward such that the deflection ledge 64*a* guides the pin into a lower slot 634 and onto the closed portion of the lower slot 634 into position 61*b*. In likewise fashion, a subsequent downward movement of the anchoring sub 10 causes the pin to move from position 61*b* upward to the open portion of the lower slot 634. Upon exiting the lower slot 634 the pin contacts the oblique angle on the lower edge of a raised finger 623 and is guided by the deflection ledge 64*b* into the transverse slot 625. Continued downward movement of the anchoring sub 10 causes the pin to travel upward the transverse slot 625 until it contacts the obliquely angled lower edge of one of the raised ledges 603, also referred to in FIG. 1*b* as the deflection ledge 64*c*. The deflection ledge 64*c* guides the pin into one of the top portion vertical slots 604. Additional downward movement of the anchoring sub 10 causes the pin to come to travel up to the closed end of the top portion vertical slot 604 in location 61*c*. The configuration of the slip assembly 40 and the slip cone 30 is such that when the pin is within location 61*c*, the slip assembly 40 circumscribes the slip cone 30 which in turn causes the radius of the slip assembly 40 to expand outward. As the radius of the slip assembly 40 expands, the rocker slips 42 of the slip assembly 40 are pushed outward into engaging contact with the wellbore. As above described, when the slip assembly 40 engages the wellbore, this locks the anchor sub 10 at that current depth within the wellbore.

During the period of time that the anchor sub 10 is anchored within the wellbore and the pin is in position 61*c*, should an upward force be applied to the mandrel 20 the slip cone 30 can be pushed up and away from the slip assembly 40. Without the presence of the slip cone 30 outwardly expanding the rocker slips 42 of the slip assembly 40, the springs 46 are able to retract the rocker slip 42 inward and away from the wellbore inner surface. Thus with continued upward force upon the mandrel 20 (or other parts of the anchor sub 10), the anchor sub 10 can be urged upward within the wellbore until the upward force diminishes.

As the mandrel 20 is moved upward toward the wellbore entrance, it will move in relation to the position of the slip assembly 40. Accordingly, the pin will move downward in the top portion vertical slot 604 away from location 61*c*. As the pin exits the top portion vertical slot 604 it will contact one of the obliques formed on the second raised section 602 and be guided into the base of the "S" shaped profile 626, which is denoted as 61*d*. Further downward movement of the pin in relation to the slotted sleeve 60 is prevented when the pin contacts location 61*d*.

Movement of the pin from location 61*c* to location 61*d* can be caused purposefully by surface personnel reeling in the wireline 54 attached to the downhole tool, by unplanned events such as an upward jolt produced by detonating a perforating gun, or by a sudden increase in wellbore pressure below the downhole tool. The unplanned events that propel the downhole tool upward are typically momentary. Thus, unless the wireline 54 is instantaneously reeled in above the upwardly moving downhole tool (which in almost all cases it is not), gravity will affect the upwardly moving downhole tool 10 to cause it to cease its upward travel, reverse direction, and re-descend back down into the wellbore.

As the anchor sub 10 of the present invention begins its re-descent into the wellbore the slip assembly 40 will begin to drag on the wellbore inner surface and in turn raise the pin from the shock position (position 61*d*) upward into contact with the deflection ledge 64*d* where the pin will be directed by the deflection ledge 64*d* into the vertical slot 65*d*. With continued downward travel of the mandrel 20 with respect to the slip assembly 40, the pin will eventually stop and reside at location 61*e*. As the pin comes to rest at position 61*e*, the slip assembly 40 is in position to re-engage the slip cone 30, as described above, thereby re-anchoring the anchor sub 10. Because the pin is retained within the shock position (position 61*d*) as the anchor sub 10 is propelled upward, the pin travels a relatively short distance (between positions 61*d* and 61*e*) before the anchoring sub 10 is re-anchored. As such, the vertical fall of re-descent of the anchor sub 10 is limited to the distance between the shock position 61*d* and location 61*e*. Accordingly, one of the many advantages of the present invention is that it can re-anchor itself within the wellbore after being propelled upward—without first allowing a protracted free fall within the wellbore. This is especially advantageous when the anchor sub 10 is suspended within the wellbore by a breakable elastic member—such as a wireline or slickline. Without the ability to re-anchor quickly, the anchor sub 10 could travel deeper into the wellbore until no slack existed in the wireline and thus subject the wireline to the impulse force of immediately stopping the downhole tool 10. Subjecting a typical wireline to such a stopping force would likely break the wireline.

The length of descent experienced by the anchor sub 10 is dependent upon the distance between the shock position (position 61*d*) and the anchor position (position 61*e*). To minimize impulse shocks to the system it is preferred that this amount of descent be limited to less than 1 foot, and more preferably 8 inches or less. It is appreciated that it is well within the capabilities of one skilled in the art to produce, without undue experimentation, an anchor sub with the appropriate slotted sleeve 60 that possesses all novel aspects of the present invention and achieves all of the objects of the present invention.

Figure 2A:
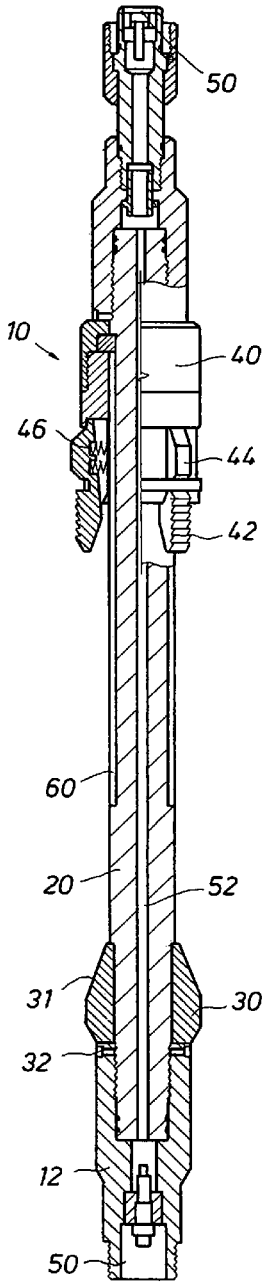
FIG. 2*a* depicts a cross sectional view of another aspect of an anchor sub of the present invention.
Figure 2B:
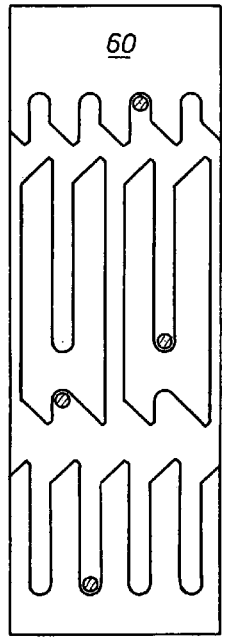
FIG. 2*b* illustrates a perspective view of another embodiment of a slotted sleeve of the present invention.
Figure 3A:
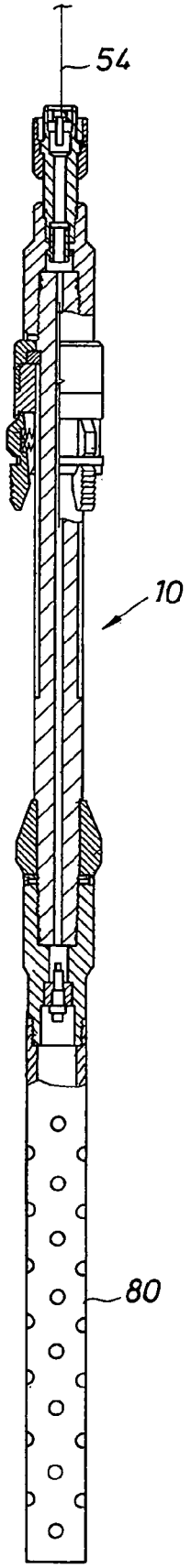
FIG. 3*a* illustrates one embodiment of the present invention combined with a perforating gun.
Figure 3B:
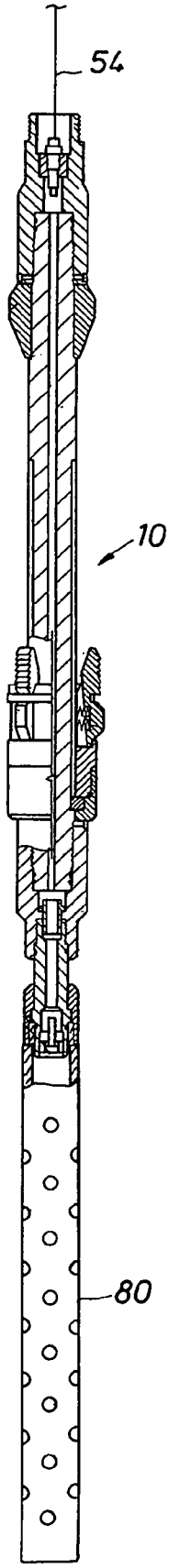
FIG. 3*b* illustrates yet another embodiment of the present invention combined with a perforating gun.

Another novel feature of the present invention is its ability to be easily reversed so that in one embodiment when the anchor sub 10 is anchored it prevents downward movement within a wellbore (as shown in FIGS. 1*a* and 1*b*), and in another embodiment it prevents upward movement within a wellbore (as shown in FIGS. 2*a* and 2*b*). This novel feature is especially advantages when the anchor sub 10 is used in combination with a perforating gun 80. For example, the embodiment of FIG. 3*a* could be well suited for an overbalanced case thereby preventing downward movement of the anchor sub 10 and perforating gun 80 subsequent to perforating when equalizing fluid flow applies downward forces to the anchor sub 10 and perforating gun. Likewise, the embodiment of FIG. 3*b* is useful in an underbalanced situation since this embodiment resists upward forces while anchored.

Yet another novel feature of the present invention is realized when used in combination with a perforation gun 80, that feature is inclusion of the shock position (position 61*d*). In some instances, for a myriad of reasons, the perforating gun 80 can be jolted upward within the wellbore upon detonation of the individual shaped charges, even when the wellbore is in an overbalanced situation and a subsequent downward motion is expected. Addition of the shock position ensures that when the anchor sub 10 and perforating gun 80 are jolted upward, the subsequent downward travel can be limited to less than a foot or even a few inches. Which provides an added measure of protection to the wireline or slickline that supports the combination within the wellbore.

It should be reemphasized that the embodiments of the present invention of FIGS. 1*a* and 1*b* can readily be converted into the embodiments of FIGS. 2*a* and 2*b* by reversing the vertical orientation of the anchor sub 10. Further, the wireline 52 within the anchor sub 10 enables connection in either orientation and will transmit data, signals, or any thing else that is typically transmitted via a wireline.

As the anchoring sub 10 is lowered into a wellbore, the pin is preferably disposed at the base of one of the inner slots 624, such as in location 61*a*—also referred to as the lowering position. Due to the symmetry of the pattern on the slotted sleeve 60, the pin can also be disposed in location 61*aa* during run in of the anchoring sub 10, which can comprise an alternative lowering position. As noted above, the frictional interaction of the drag blocks 44 rubbing against the inner diameter of the wellbore will push the slip assembly 40 upward on the mandrel 20 to retain the pin in the lowering position.

To anchor the anchoring sub 10 while it is within the wellbore, the anchoring sub 10 is pulled upward, typically by an attached wireline 54. As the anchoring sub 10 is pulled upward, the direction of the frictional force experienced by the drag blocks 44 reverses direction and pushes downward on the slip assembly 40, that in turn causes the pin to relocate from the lowering position 61*a* to the base of the lower slot 634 in location 61*f*. Since location 61*f* is in the lower portion of the slotted sleeve 60, far disposed from the slip cone 30, a subsequent downward movement of the anchoring sub 10 is required. In the manner above described, lowering the mandrel 20 at this point will cause the slip assembly 40 to move upward with respect to the mandrel 20. Consequently, the pin will move from location 61*f*, through the transverse slot 625, move past the deflection ledge 64*c* on one of the raised ledges 603 and into the anchoring location 61*c*.

In order to retrieve the anchoring sub 10 from the wellbore, the anchoring sub 10 is again pulled which causes the pin to relocate into the shock position 61*d*. The anchoring sub 10 is then lowered until the pin travels up an upper slot 604 into location 61*e*—which is the same as the re-anchor position. A yet subsequent upward tug on the anchoring sub 10 causes the pin to move downward from location 61*d*, through an upper slot 604, into a transverse slot 625, and finally into a lower slot 634 where it can reside in the pull up position 61*g*. Once in the pull up position 61*g*, the slip assembly 40 is far from engagement with the slip cone 30, and will not produce an anchoring force on the anchoring sub. Thus the anchoring sub 10 can easily be raised out of the wellbore at this time. It should be noted, that the anchoring sub 10 can be pulled from the wellbore if the pin resides at the base of any of the lower slots 634. With regard to the embodiment of the present invention where the mandrel 20 is reversed and the slip assembly 40 resides above the slip cone 30, the lowering, anchoring, and retrieval is accomplished in like fashion as the embodiment described above.

In order to selectively engage the slip assembly 40 with the pattern, the personnel raising and lowering the anchoring sub 10 must be cognizant of the proper distance required for subsequent raising and lowering of the anchoring sub 10. Thus the distances between the different locations (61*a*-61*f*) should be known and available to the operations personnel. It is believed that it is well within the capabilities of those skilled in the art to reference the distances between locations and subsequently properly operate the anchoring sub 10.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the pattern of raised ledges, fingers, studs, and slots could be replaced with another pattern that cooperates with an anchoring device that provides a similar result—that is the ability selectively anchor an anchoring sub, and automatically re-anchor an anchoring sub after any upward jolt that dislodges the anchoring sub from the wellbore. These and other similar modifications will readily suggest themselves to those skilled in the art, and are intended to be encompassed within the spirit of the present invention disclosed herein and the scope of the appended claims.

What is claimed is:

1. An anchoring device for use with a perforating gun within a wellbore, said anchoring device comprising:

a mandrel disposed in a first position having a pattern formed on the outer surface of said mandrel; and a slip assembly slideably positioned on said mandrel, wherein selective disposition of said slip assembly with said pattern in an anchoring position anchors said anchoring device and wherein said pattern is configured to guide said slip assembly into a gun shock position during upward movement of the anchoring device, wherein the second position de-anchors said anchoring device, and said pattern is configured to automatically guide said slip assembly into another anchoring position upon the next downward movement of the anchoring device.

2. The anchoring device of claim 1, wherein said slip assembly anchors said anchoring device to the wellbore.

3. The anchoring device of claim 1, wherein said slip assembly automatically becomes selectively repositioned on said pattern with vertical movement of said anchoring device.

4. The anchoring device of claim 1, further comprising a slip cone disposed on said mandrel engageable by said slip assembly, such that by engaging said slip cone, said slip assembly is urged outward into anchoring contact with the wellbore.

5. The anchoring device of claim 1 further comprising at least one drag slip disposed on said slip assembly, said drag slip contactable with the wellbore thereby providing a drag force onto said slip assembly when said anchoring device moves within the wellbore, where the drag force has a direction opposite to the direction of movement of said anchoring device.

6. The anchoring device of claim 1, wherein said mandrel is in a second position that is vertically reversed from said first position, wherein selective disposition of said slip assembly with said pattern anchors said anchoring device to the wellbore against movement opposite in direction to the movement anchored against in claim 1.

7. The anchoring device of claim 1, wherein said slip assembly is engageable with said pattern in an anchoring position, a shock position, a lowering position, and a raising position.

8. The anchoring device of claim 7, wherein said slip assembly anchors said anchoring device within the wellbore.

9. The anchoring device of claim 7, wherein when said slip assembly is engaged with said pattern in the shock position, said anchoring device is motivatable in a first vertical direction and limited in its movement in a second vertical direction.

10. The anchoring device of claim 9, wherein said anchoring device limits travel in the second vertical direction to less than 1 foot.

11. The anchoring device of claim 9, wherein said anchoring device limits travel in the second vertical direction to less than 8 inches.

12. The anchoring device of claim 9, wherein said first vertical direction is upward and said second vertical direction is downward.

13. The anchoring device of claim 9, wherein said first vertical direction is downward and said second vertical direction is upward.

14. The anchoring device of claim 7, wherein when said slip assembly is engaged with said pattern in the lowering position, said anchoring device is upwardly and downwardly motivatable.

15. The anchoring device of claim 7, wherein when said slip assembly is engaged with said pattern in the raising position, said anchoring device is upwardly and downwardly motivatable.

16. The anchoring device of claim 1, wherein said anchoring device vertically moves in a first direction and then vertically moves in a second direction prior to being re-anchored.

17. The anchoring device of claim 16, wherein the distance traveled during movement of said anchoring device in the second direction is less than the distance traveled during movement in the first direction.

18. The anchoring device of claim 16, wherein the movement of said anchoring device in the second direction is less than 1 foot.

19. The anchoring device of claim 18 further wherein said slip assembly comprises at least one rocker slip engageable with the wellbore to provide anchoring contact with the wellbore.

20. The anchoring device of claim 16, wherein said vertical movement in a first direction comprises upward movement and said vertical movement in a second direction comprises downward movement.

21. The anchoring device of claim 16, wherein said vertical movement in a first direction comprises downward movement and said vertical movement in a second direction comprises upward movement.

22. The anchoring device of claim 1 further comprising a pin connected to the slip assembly and formed for travel within the pattern, wherein the pattern comprises an upper section and a mid section, wherein the upper section includes substantially vertical slots each closed at the top that form the anchoring position, and wherein the vertical slots are open at the bottom, and wherein the mid section comprises raised portions having an "S" shaped profile on their respective upper ends that form the gun shock position, wherein the "S" shaped profile is formed to redirect the pin from one upper section vertical slot to an adjacent upper section vertical slot on an upward and subsequent downward movement of the anchoring device within the wellbore thereby automatically re-anchoring the device.

* * * * *